United States Patent [19]

Stephens

[11] Patent Number: 5,066,153

[45] Date of Patent: Nov. 19, 1991

[54] PAPER SHEAR FOR PRINTER

[75] Inventor: Fred O. Stephens, Waynesboro, Va.

[73] Assignee: Genicom Corporation, Waynesboro, Va.

[21] Appl. No.: 491,839

[22] Filed: Mar. 12, 1990

[51] Int. Cl.[5] ..... B41J 11/70

[52] U.S. Cl. ..... 400/621; 83/483; 83/583; 101/226

[58] Field of Search ..... 400/621, 621.1, 621.2, 400/320; 101/143, 224, 226, 227; 83/508, 509, 469, 471.2, 483, 583

[56] References Cited

U.S. PATENT DOCUMENTS

| | | | |
|---|---|---|---|
| 3,566,725 | 3/1971 | Sutyak | 83/407 X |
| 3,593,659 | 7/1971 | Brackett | 101/143 |
| 3,958,477 | 5/1976 | Carlson | 83/508 X |
| 3,981,215 | 9/1976 | Granger et al. | 83/508 X |
| 4,152,962 | 5/1979 | Hendrischk | 83/508 X |
| 4,504,162 | 3/1985 | Speraggi | 400/621 |
| 4,525,088 | 6/1985 | Shipos et al. | 400/621 |
| 4,701,063 | 10/1987 | Wysk et al. | 400/621 |

*Primary Examiner*—Edgar S. Burr
*Assistant Examiner*—Moshe I. Cohen
*Attorney, Agent, or Firm*—Nixon & Vanderhye

[57] ABSTRACT

A paper shear includes a flat disk with unsharpened edges pivotally mounted on an assembly carried by the printer carriage. The paper shear is pivoted between paper shearing engaged and disengaged positions relative to a shear platen. The mounting assembly includes a linear actuator and a mounting plate cooperable to pivot the paper shear into the engaged position at an extreme end of carriage travel and maintain it in the engaged position upon movement of the carriage in the opposite direction to shear the paper. The actuator and plate are then relatively displaced at the opposite extreme end of travel to pivot the paper shear into its disengaged position, whereby printing can be resumed.

21 Claims, 5 Drawing Sheets

PAPER SHEAR FOR PRINTER

BACKGROUND AND SUMMARY OF THE INVENTION

The present invention relates to a paper shear for a serial printer and particularly to a paper shear for shearing continuous forms or bursting the forms along their perforations.

In serial printers, continuous forms which have been printed have been traditionally separated from those not printed by manually tearing the paper at a fold or perforation line. Frequently, the forms are separated by tearing the forms against a tear bar or an edge carried by the printer. Certain printers have control features which permit the printed media to be moved automatically to a convenient tear-off position whereby the fold or perforation lines are accessible, for example, for tearing against an edge.

In a known paper or form separating mechanism for serial printers, there is provided a sharp, knife-edged wheel which engages in a groove formed in a platen. The wheel is drawn across the paper to cut through the form. However, several problems occur with paper separation devices of this type. For example, most forms are quite abrasive and the knife edge is quickly dulled. More importantly, there is a substantial safety hazard when using a knife edge disposed in the printer for separating the forms. For example, the knife must be handled by the operator for installation purposes, i.e., original equipment as well as retrofits, and the sharpness of the knife edge constitutes a safety hazard. Additionally, the knife is often located near the ribbon adjacent the print line of the carriage. Thus, when an operator changes the print ribbon, his hand or hands must be located and manipulated in the immediate vicinity of the sharpened knife edge, rendering the operator vulnerable to injury. This problem has been recognized and protective safety covers have been proposed for installation about the sharp edges of the knife to reduce these safety hazards. However, the knife blade, at least in operation, must, by necessity, protrude past the safety cover to sever the form. Because of the danger of inadvertent contact by an individual with the knife edge, most serial printers do not contain apparatus for automatically severing the printed portion of continuous forms from the unprinted form portion.

Concurrently, however, recent developments in the sophistication of serial printer paper handling have made the ability to cut forms or burst perforations much more important. For example, remote operation of a printer with two or more parkable continuous form paper paths is highly desirable. That type of operation requires an apparatus for automatically separating the continuous forms.

More particularly, it is desirable to print on one type of a continuous form, remove that printed form from the unprinted continuous form and then print on another type of continuous form and remove that printed form from the second continuous form and so on. The capacity to print on different continuous forms using one printer is thus a highly desirable print feature necessitating use of a form separating mechanism.

According to the present invention, there is provided a paper shear for use on serial printers for shearing continuous forms or bursting their perforations which eliminates or minimizes the foregoing and other disadvantages associated with the above-discussed and other printer paper separation devices and provides a novel and improved paper shear and a method of shearing continuous forms. Particularly, the present invention provides a paper shear which does not rely on a sharpened or knife edge for severing the paper and therefore does not present the above-identified and other safety problems associated with a forms separating device having a knife edge. To accomplish this, the paper shear hereof preferably comprises a cylindrical disk or a slightly conically shaped disk mounted on a mechanism for engaging and disengaging the shear relative to the paper and which mechanism, in turn, is carried by the print head carriage. Carriage motion is employed to displace the shear into a position wherein a paper shearing action, rather than a paper cutting action, is provided.

To accomplish this, the paper shear is mounted for movement between a first position retracted from an associated shear platen and a second position poised for engagement with a resisting edge on the shear platen. When it is desired to shear paper in the printer, the appropriate printer control displaces the carriage into a position adjacent an extreme end of its travel, at which time an actuator displaces the paper shear from the first position into an intermediate position spaced from a recessed edge of the shear platen and to one side of the paper in the printer. The shear platen is thus poised beyond the lateral edge of the paper in the printer for traversing movement across the paper with the carriage. To provide a shearing action, the shear platen has a cam edge spaced longitudinally from the recessed edge of the platen. Thus, at the beginning of carriage movement in the direction crossing the paper, the carriage displaces the shear from the recessed platen edge and along the cam edge thereof, eliminating the clearance therebetween and creating an interference between a resisting edge of the shear platen and the shear. With the form to be cut lying against the shear platen, further traversing movement of the carriage draws the paper shear into engagement with and across the paper, shearing the form. The printed form can then be ejected from the printer and the unprinted paper parked in its paper path or returned to the print line. Upon reaching the end of carriage movement in that one traversing direction, the paper shear is displaced into its disengaged position relative to the forms.

In accordance with another aspect of the present invention, there is provided a modular linkage mechanism for displacing the paper shear between positions engaging and disengaging the paper shear and the resisting edge of the shear platen by converting a translational motion of the carriage to a rotational motion of the paper shear. The paper shear and mechanism also provide stops and locking angles for guaranteed engagement and disengagement. For example, paper shear engagement and disengagement positions relative to the shear platen are maintained by an overcenter spring which holds the paper shear in its desired position. Moreover, the paper shear is further maintained in its engaged position by a bias applied thereto when the paper shear is engaged and the carriage is moved in the direction shearing the form. Carriage motion in the opposite direction tends to disengage the paper shear from the shear platen.

The present invention is particularly useful with printers which enable two different forms to be sequentially printed. In printers of that type, there are a pair of parkable continuous forms paper paths enabling the printer to be loaded with two different forms simultaneously. Bills and receipts at a retail outlet or tickets and itinerary at a travel agency are examples of these two different types of forms. The paper shear hereof enables each form to be printed and then sheared off. The other form can then be printed and sheared. Thus, bills and receipts can be intermingled and sheared on the same printer for collation without operator intervention. Likewise, ticket stock and itinerary can be mixed and sheared on the same printer for removal and collation such that a first string of tickets goes with the first itinerary right behind them. Manual intervention is thus not required.

In a preferred embodiment according to the present invention, there is provided a paper printer comprising a paper shear, means carried by the printer mounting the paper shear for movement traversing the paper in the printer, a shear platen carried by the printer, the platen having a surface for bearing engagement with the paper being printed and a resisting edge adjacent the surface and means for selectively engaging and disengaging the paper shear and platen such that, when engaging the platen, the paper shear engages the paper and the resisting edge to shear the paper in response to traversing movement of the paper shear.

In a further preferred embodiment according to the present invention, there is provided a paper printer, comprising a carriage carried by the printer for movement traversing the paper in the printer, a paper shear carried by the carriage for movement therewith traversing the paper in the printer, a shear platen fixed in the printer and means for selectively engaging and disengaging the paper shear and the platen such that, when engaging the platen, the paper shear engages the paper to shear the paper in response to traversing movement of the paper shear. Means responsive to traversing movement of the carriage are also provided for displacing the paper shear between one of the engaged and disengaged positions and the other of the engaged and disengaged positions.

In accordance with another aspect of the present invention, there is provided, in a paper printer carrying a paper shear and a shear platen, a method of shearing the paper comprising the steps of, displacing the paper shear from a first position spaced from the shear platen into a second position adjacent an edge of the shear platen, traversing the paper shear across the width of the paper in the printer when the paper shear lies in the second position and, when in the second position, engaging the paper shear with the platen such that the paper shear engages the paper and the edge to shear the paper in response to traversing movement of the paper shear.

Accordingly, it is a primary object of the present invention to provide a novel and improved paper shear for serial printers which employs a shearing rather than cutting action to separate the forms, thereby eliminating safety hazards associated with sharp edges and to provide a novel and improved linkage for engaging and disengaging the paper shear and a shear platen, as well as to lock the shear platen in predetermined positions.

It is also an object of this invention to provide a novel and improved method of shearing continuous forms in serial printers.

These and further objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Reference will now be made in detail to the present preferred embodiment of the invention, an example of which is illustrated in the accompanying drawings.

Figure 1:
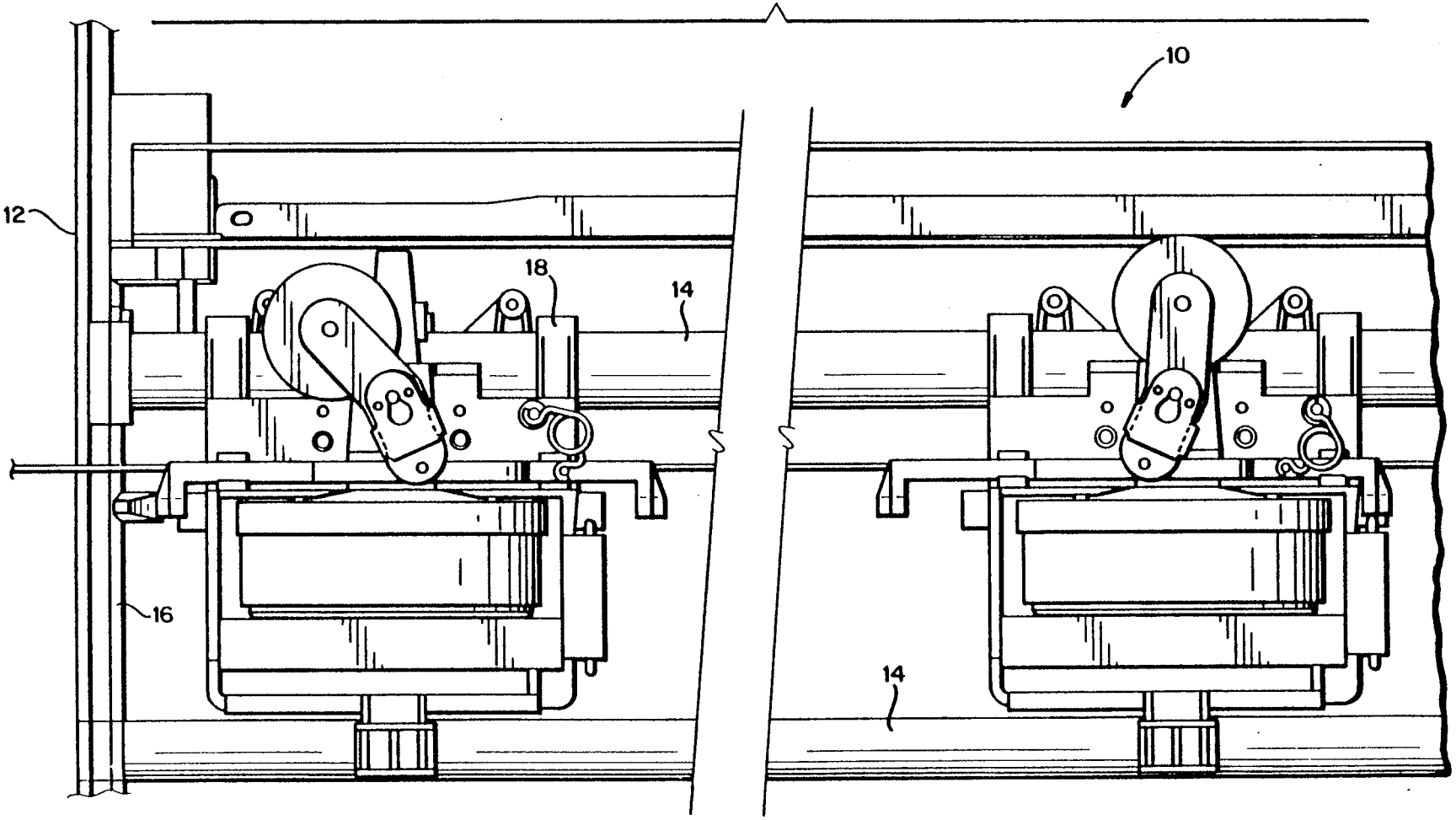
FIG. 1 is a fragmentary plan view of a serial printer mounting a paper shear constructed in accordance with the present invention and illustrating the paper shear in positions engaged with and disengaged from the platen in the right and left drawings in the Figure.
Figure 2:
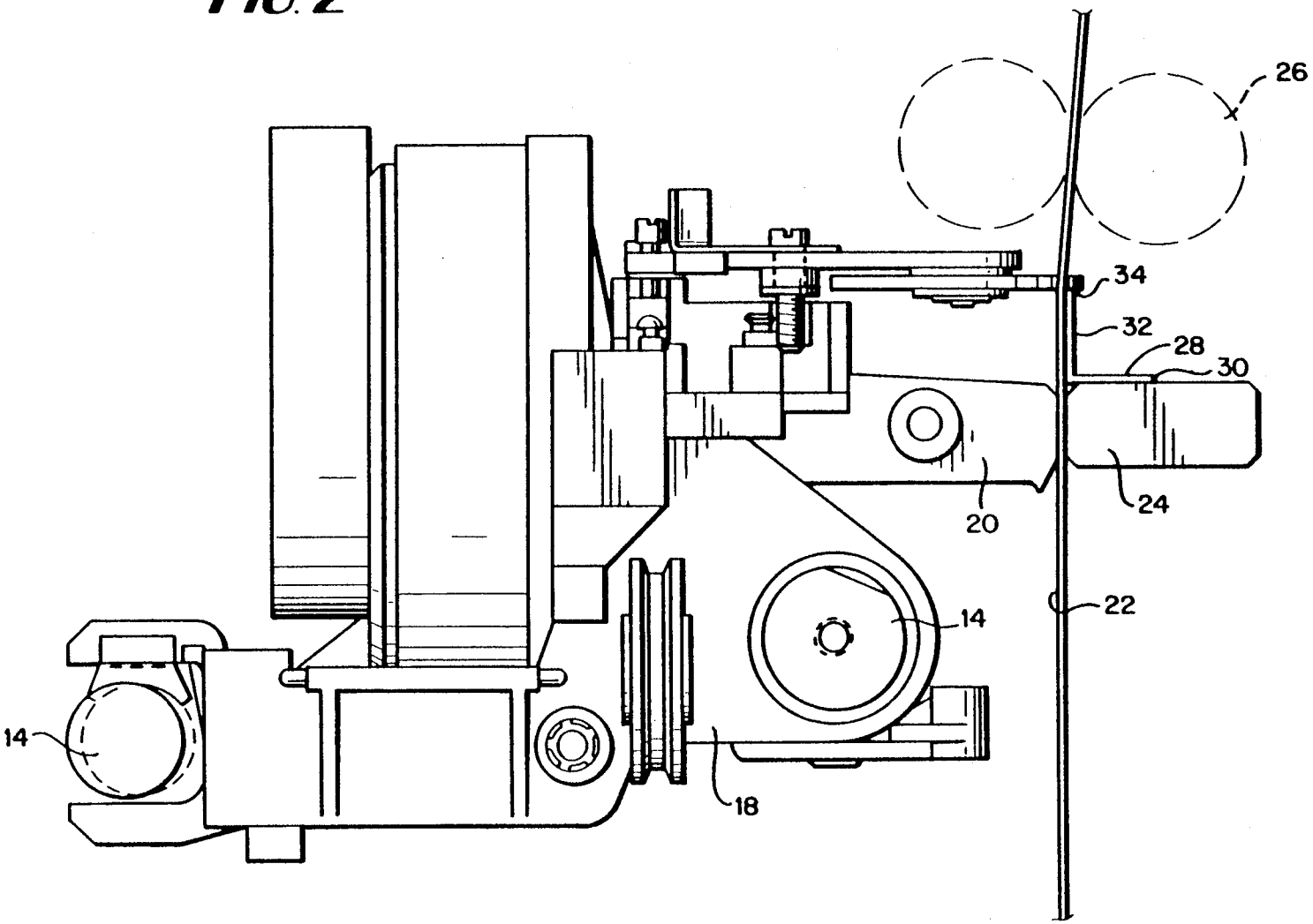
FIG. 2 is an enlarged fragmentary side elevational view of the carriage mounting the paper shear and illustrating the paper shear in its engaged position and traversing the paper.

Referring now to the drawing figures, particularly to FIGS. 1 and 2, there is illustrated a printer, generally designated 10, including a printer frame 12. Frame 12 includes a pair of rails 14 which extend between opposite sides of the printer and are mounted in printer side frames 16, only one of which is illustrated in FIG. 1. A carriage 18 is mounted on rails 14 for traversing movement from side to side of the printer. Carriage 18 carries a print head 20 for printing on a recording medium 22 (FIG. 2) disposed between the print head 20 and a print platen 24. The carriage and print head per se do not form part of the present invention and may be of conventional construction, it being sufficient to note that carriage 18 is mounted for traversing movement from side to side on rails 14 for establishing one or more print lines on the recording media during its traverse. As illustrated in FIG. 2, the recording media 22 is moved, by conventional means, not shown, in an upward direction in that drawing figure for egress from the printer through a pair of exit rollers 26.

Figure 11:
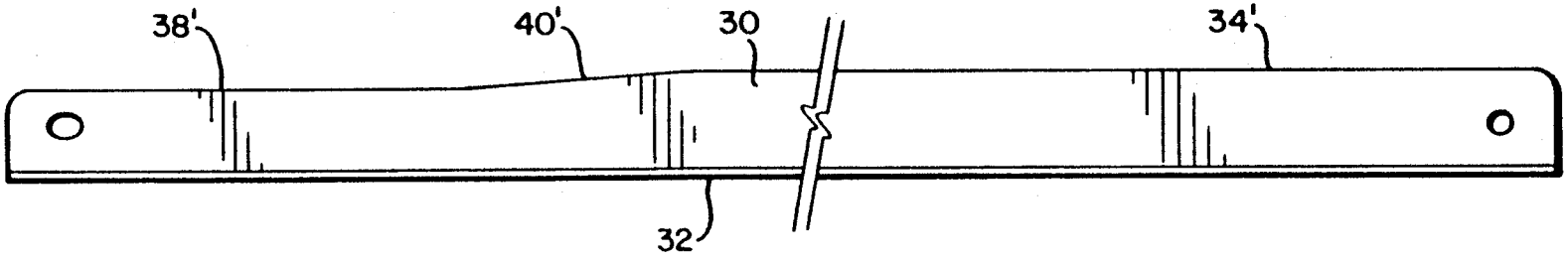
FIGS. 11 and 12 are top and front elevational views, respectively, of a shear platen.
Figure 12:
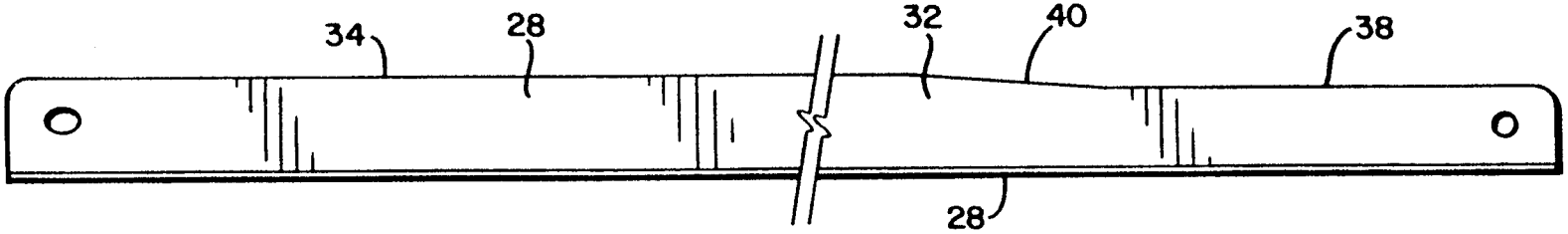

To shear the paper in accordance with the present invention, there is provided a shear platen 28 which extends between the opposite sides of the printer and is mounted on the print platen 24. As best illustrated in FIGS. 2, 11 and 12, shear platen 28 comprises an elongated member bent lengthwise at substantially right angles to form a base portion 30 for connection to print platen 24 and a vertically extending portion 32 forming a backing for the recording media 22 en route between print head 20 and exit rolls 26. The upper edge of backing portion 32 has a resisting edge 34, a clearance edge 38 and a cam edge 40 between edges 38 and 34 for reasons which will become apparent from the ensuing description. It will also be appreciated from a review of FIGS. 11 and 12 that base platen portion 30 likewise has a resisting edge portion 34', a clearance edge portion 38' and a cam edge portion 40'. By locating these edges oppositely on the base and backing portions 30 and 32 of the platen, the platen may be mounted interchangeably in the printer without regard to which end is the right or lefthand end during mounting.

The paper shear according to the present invention is generally designated 44 (FIG. 3) and includes a support arm 46 having angularly related front and rear portions 48 and 50, respectively. Toward the distal end of the rear portion 50 of arm 46, there is mounted a cylindrical disk 52 for free pivotal movement on a pin 54 secured to the arm 46. While the disk 52 is depicted in a flat configuration, i.e., with substantially parallel, flat side surfaces 53, 55 it will be appreciated that a slightly conical configuration may likewise be utilized. It will also be appreciated that the peripheral edge 56 of the disk 52 is unsharpened, preferably flat to thereby provide a substantially square cutting edge 57. Arm 46 is pivotally mounted on a shear mounting plate 58 by an adjustment screw 60. A bracket 62 overlies the front portion 48 of arm 46 and has openings through which the pin 60 extends. It will be appreciated that by threading and unthreading the adjustment screw 60, the height of the shear arm 46 and, hence, shear disk 52, may be adjusted in relation to shear platen 28. This is necessary because of the large potential cumulation of tolerances at the engagement of the paper shear and shear platen from the paper shear 44 through its mounting mechanism to the carriage 18, back through rails 14 to the printer frame 16. Locking threads are provided in the mounting plate 58 to hold the adjusted position of the paper shear during operation, machine vibration and shipping.

Adjacent the rear end of the front portion 48 of arm 46 there is provided an engagement pin 66 which depends below arm 46 for engagement in a slot 68 formed in a linear actuator 70. The linear actuator 70 and the mounting plate 58 form a mounting mechanism for the paper shear 44 and are best illustrated in FIGS. 5–10.

Figure 8:
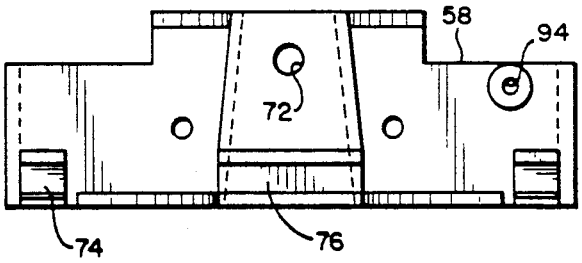
FIGS. 8, 9 and 10 are respective top plan, front elevational and end elevational views of a mounting plate forming part of the mechanism for mounting the paper shear.
Figure 9:
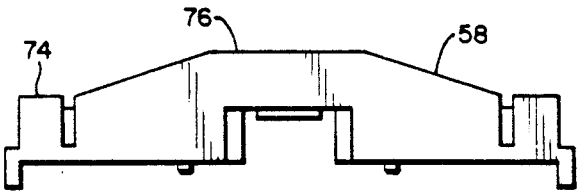
Figure 10:
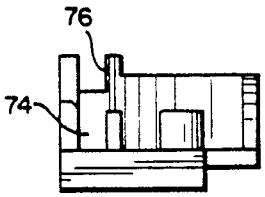

Referring now to FIGS. 8–10, mounting plate 58 includes an internally threaded opening 72 for receiving the threaded adjustment screw 60. Mounting plate 58 also carries along its upper surface a pair of end guides 74 and a central or intermediate guide 76. Each guide includes a pair of side walls which project upwardly and in spaced relation front to rear from one another. The mounting plate 58 is suitably secured, by means not shown, to the carriage 18 for traversing movement therewith on rails 14.

Figure 5:
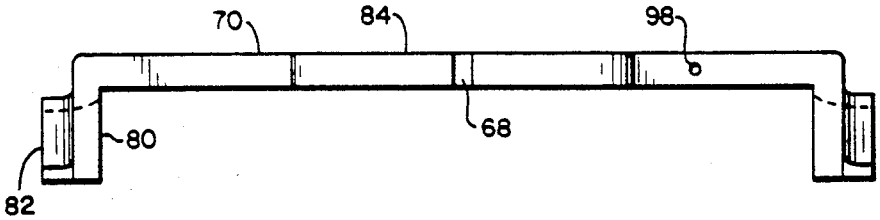
FIG. 5, 6 and 7 are respective top plan, front elevational and end views of a linear actuator used in the mounting mechanism for the paper shear hereof.
Figure 6:
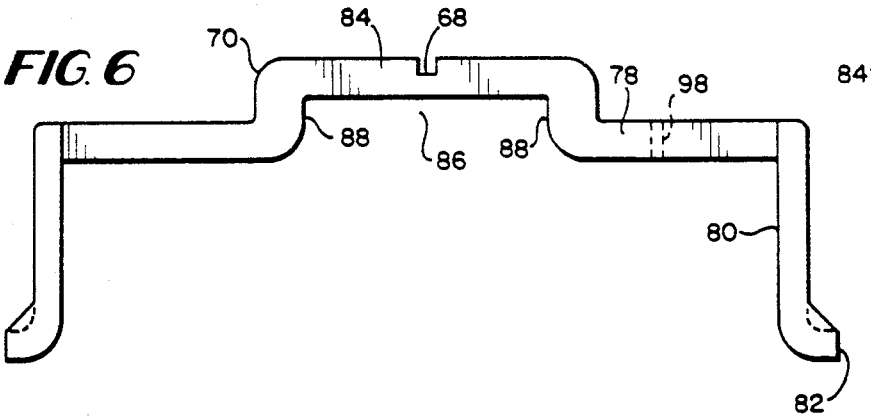
Figure 7:
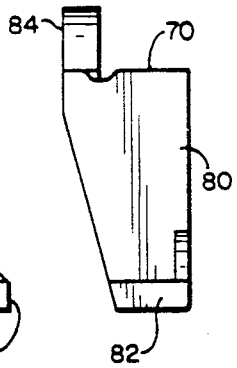

With reference to FIGS. 5–7, linear actuator 70 includes a generally elongated bar 78 having depending legs 80 adjacent opposite ends, terminating in lower abutments 82. The elongated bar 78 includes a raised central portion 84 defining along its underside an elongated slot 86 terminating at opposite ends in stops 88. The upper surface of the central portion 84 carries the slot 68 for receiving the engagement pin 66 of arm 46.

Figure 3:
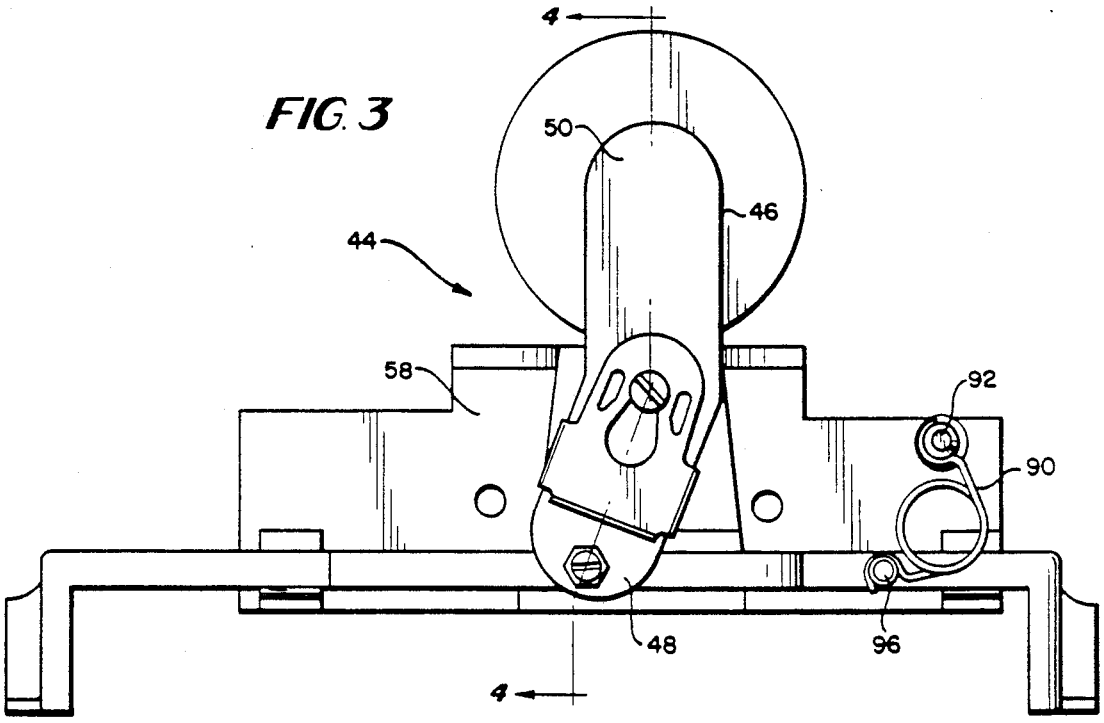
FIG. 3 is an enlarged plan view of the paper shear and mounting mechanism therefor.
Figure 4:
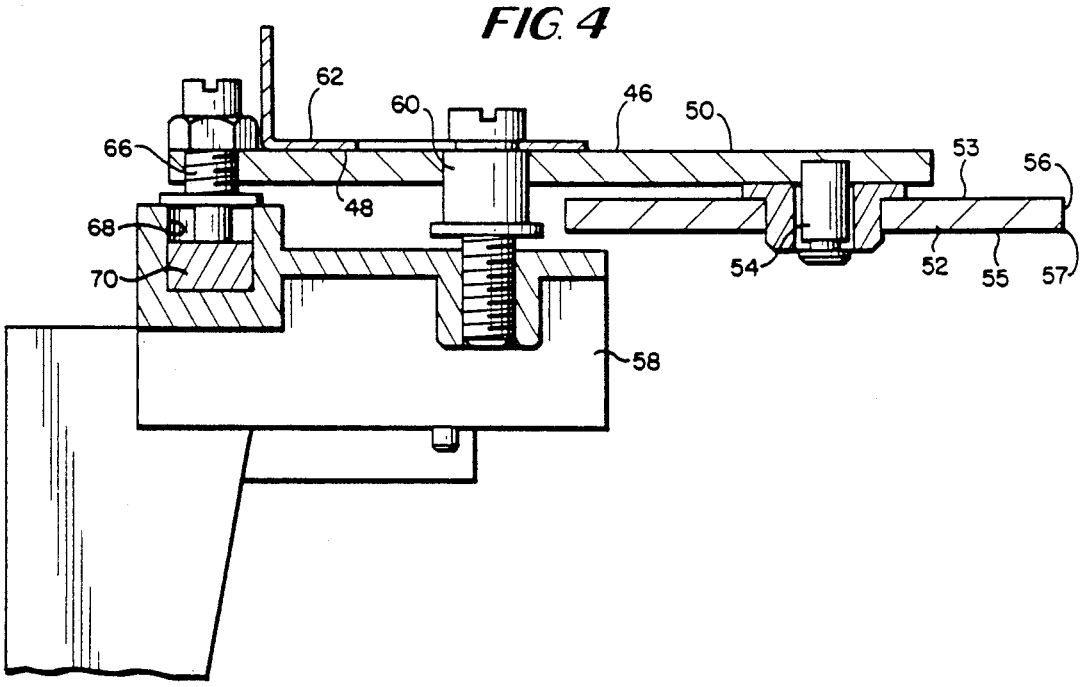
FIG. 4 is an enlarged cross-sectional view thereof taken generally about on line 4—4 in FIG. 3.

In the assembly of mounting plate 58 and actuator 70, as best illustrated in FIG. 3, the elongated bar 78 is disposed in the end guides 74 of the mounting plate 58, and its central portion 84 rests in the intermediate guide 76. From a comparative review of FIGS. 6 and 8, it will be appreciated that the width of the intermediate guide 76 is substantially less than the length of the recess 86 along the underside of actuator 70. As a consequence, actuator 70 is slidable linearly from side to side relative to mounting plate 58 between extreme positions where the stops 88 abut the base of intermediate guide 76. It will also be appreciated that, because adjustment screw 60 pivotally mounts arm 46 to mounting plate 58 and engagement pin 66 engages in slot 68 of the linear actuator 70, relative linear movement between mounting plate 58 and actuator 70 causes the paper shear arm 46 to pivot between paper shear engaged and disengaged positions as illustrated in the right and lefthand illustrations, respectively, of the paper shear in FIG. 1. That is, in one extreme position of the mounting plate 58 and actuator 70, paper shear arm 46 may be pivoted such that shear disk 52 is spaced or retracted from the shear platen 28 (the disengaged position illustrated in the lefthand drawing of FIG. 1), whereas when the linear actuator and mounting plate are moved relatively into the opposite extreme position, shear platen arm 46 is pivoted to locate the shear platen 52 in a position overlying the upper edge of shear platen 28 (the engaged position illustrated in the righthand drawing of FIG. 1). It will be appreciated further that paper shear 44 lies in the retracted position during printing operations and is extended into the position illustrated in the righthand drawing of FIG. 1 only during paper shearing operations.

Referring now to FIG. 3, an overcenter spring 90 is connected at opposite ends to mounting plate 58 and linear actuator 70. Particularly, one end of the spring 90 is mounted to a pin 92 disposed in an opening 94 in the mounting plate 58. The opposite end of the spring is carried on a pin 96 projecting upwardly from an opening 98 formed in the linear actuator 70. The overcenter spring 90 serves to bias the linear actuator for movement into one of its extreme positions with its stop 88 engaged against the intermediate guide 76 on mounting plate 58 once actuator 70 is moved to an overcenter position relative to mounting plate 58. Thus, overcenter spring 90 serves to bias linear actuator 70 toward one or the other of its extreme positions relative to the mounting plate and maintain it in such position until the actuator is subsequently displaced.

In operation, standard control features on the printer displace the carriage such that it traverses the recording medium 22 disposed in the printer. When printing, the paper shear 44 is disposed in its retracted position as illustrated in the lefthand drawing in FIG. 1. When printing, the carriage does not reach the extreme ends of its travel. Rather, the control features control the carriage for back-and-forth movement short of moving it or any of its associated parts, including the linear actuator, into engagement with the side frame. When it is desired to shear the recording medium 22 in the printer, the control features will move the carriage into an extreme position at one end of its traversing movements relative to the printer. As illustrated, the carriage will be moved to the extreme righthand position such that traversing movement of the carriage from right to left in FIG. 1 performs the shearing operation.

When the carriage is moved into its extreme righthand position, abutment 82 on linear actuator 70 engages a side frame of the printer and thus mounting plate 58 and actuator 70 are relatively displaced, causing arm 46 of paper shear 44 to pivot, for example, in the clockwise direction as illustrated in FIG. 1, into the engaged position. More particularly, the engagement of abutment 82 against the side frame causes overcenter spring 90 to displace the actuator 70 relative to mounting plate 58 such that the righthand stop 88 of actuator 70 engages the righthand side of intermediate guide 76. With the engagement pin 66 located in slot 68, this relative movement causes arm 46 to pivot in the clockwise direction, locating paper shear disk 52 in its engaged position above the recessed edge portion 38 of shear plate 28.

As the carriage under control of the printer is moved from right to left, paper shear disk 52 moves from its position overlying recessed edge 38 into engagement with cam edge 40 of shear platen 28. Continuing carriage travel to the left, as illustrated in FIG. 1, causes shear disk 52 to travel up the cam edge 40, taking up all clearances and tolerances as previously discussed, and into a position interfering slightly with the top resisting edge 34 of the platen 28. Consequently, a pressure between shear disk 52 and shear platen 28 obtains, with the flat undersurface of disk 52 engaging resisting edge 34. By continuing to move the carriage from right to left, as illustrated in FIG. 1, the paper shear is drawn across the shear platen to shear the paper, the flat edge 56 first engaging the paper and the interference between the undersurface of disk 52 and resisting edge 34 shearing the paper. While the overcenter spring 90 tends to maintain the arm 46 in the paper shear engaged position, it will also be appreciated that the normal forces generated from the shearing action including the drag on the paper shear from the platen and paper shearing operation tend to maintain the arm in the paper shear engaged position with the linear actuator in its extreme position, as illustrated in FIG. 3. Thus, any reversal of the direction of movement of the carriage would tend to withdraw the shear from its engaged to its disengaged position.

When the paper shear 44 has completely sheared the paper, the carriage will continue to move to an extreme lefthand position, as illustrated in FIG. 1. At that position, the lefthand abutment 82 will engage the side frame of the printer, causing relative linear movement between actuator 70 and mounting plate 58. This relative movement enables an edge of slot 68 of actuator 70 to displace the engagement pin 66 relative to the mounting plate 58 to pivot arm 46 in a counterclockwise direction, i.e., into the paper shear disengaged position. More particularly, when actuator 70 and mounting plate 58 are relatively displaced, overcenter spring 90, once actuator 70 and plate 58 obtain an overcenter position, causes their further relative displacement such that the lefthand stop 88 engages the left side of intermediate guide 76 of plate 58 whereby arm 46 pivots the paper shear into its disengaged position. Consequently, further printing may be resumed upon movement of the carriage from left to right.

As explained above, the recording medium is sheared, in accordance with the present invention, rather than cut. This enables the use of a shear disk which has no sharpened edges and which therefore does not constitute a safety hazard for operators of the printer. Operators may reach into the printer, for example, when changing ribbons, without danger of injury.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A paper printer, comprising:

a paper shear having a substantially square cutting edge;

means carried by the printer mounting said paper shear for movement traversing the paper in the printer;

a shear platen carried by the printer, said platen having a surface for bearing engagement with the paper being printed and a resisting edge adjacent said surface;

means for selectively engaging and disengaging said paper shear and platen such that, when engaging said platen, said substantially square cutting edge engages the paper and the resisting edge to shear the paper in response to traversing movement of said paper shear; and cam means on said shear platen for selectively pressure engaging said paper shear and said platen such that, when engaging said platen, said paper shear engages the paper to shear the paper in response to traversing movement of said paper shear.

2. A printer according to claim 1 wherein said paper shear has a flat, non-sharpened peripheral edge for engaging the paper against said platen prior to shearing the paper.

3. A printer according to claim 2 wherein said paper shear has a flat side surface which engages the resisting edge during shearing.

4. A printer according to claim 3 including means for relatively biasing said flat side surface and said resisting edge into engagement one with the other and maintaining said surface in biased engagement with said resisting edge during traversing movement of said paper shear.

5. A printer according to claim 4 including means for establishing a clearance between said paper shear and said platen adjacent an end of the traversing movement of said paper shear and means responsive to said traversing movement of said paper shear for eliminating said clearance and engaging said paper shear and said resisting edge to shear the paper in response to further traversing movement.

6. A printer according to claim 1 wherein said shear platen is fixed in said printer, said substantially square cutting edge including a non-sharpened peripheral edge for engaging the paper against said resisting edge prior to shearing the paper and a flat side surface for engaging the resisting edge of said shear platen, said paper shear being carried for traversing movement between opposite sides of the printer to traverse the full width of paper being printed, said resisting edge having at one end thereof adjacent one side of the printer an edge portion spaced from said paper shear to establish a clearance therebetween and a cam edge portion connecting said spaced edge portion and said resisting edge, said flat side surface of said paper shear being engageable with said cam edge portion to bias said paper shear into engagement therewith such that said paper shear bears against said resisting edge in response to traversing movement of said paper shear in a direction away from said spaced edge portion for shearing the paper.

7. A printer according to claim 1 including a carriage carried by the printer for movement traversing the paper in the printer, means mounting said paper shear on said carriage for movement between a first position spaced from said platen and the paper engaged therewith and a second position adjacent said platen for shearing the paper, and means responsive to said traversing movement of said carriage for displacing said paper shear between one of said first and second positions and the other of said first and second positions.

8. A printer according to claim 7 wherein the printer includes a frame, said displacing means including an actuator carried by said carriage for movement relative thereto in response to engagement with said frame, and means connecting said actuator and said paper shear for moving said shear between said first position and said second position in response to engagement of said actuator and said frame.

9. A printer according to claim 8 wherein said shear is pivotally carried by said carriage, and means connecting said actuator and said paper shear for pivoting said paper shear between said first position and said second position in response to engagement of said actuator and said frame.

10. A printer according to claim 9 wherein said actuator is mounted for linear sliding movement relative to said carriage.

11. A printer according to claim 9 wherein said actuator has a pair of elements for engaging said frame respectively in response to traversing movement of said carriage in opposite directions, one element engaging said frame on one side of said carriage for moving said paper shear from said first position to said second position and the other of said elements engaging said frame on the other side of said carriage for moving said paper shear from said second position to said first position.

12. A printer according to claim 11 including a spring carried by said carriage for maintaining said paper shear in said first and second positions.

13. A paper printer, comprising:

a carriage carried by said printer for movement traversing the paper in the printer;

a paper shear having a substantially square cutting edge carried by said carriage for movement therewith traversing the paper in the printer;

a shear platen fixed in said printer;

cam means on said shear platen for selectively pressure engaging said paper shear and said platen such that, when engaging said platen, said paper shear engages the paper to shear the paper in response to traversing movement of said paper shear; and means responsive to traversing movement of said carriage for displacing said paper shear between engaged and disengaged positions with said platen.

14. A printer according to claim 13 wherein the printer includes a frame, said displacing means including an actuator carried by said carriage for movement relative thereto in response to engagement with said frame, and means connecting said actuator and said paper shear for moving said shear between said engaged position and said disengaged position in response to engagement of said actuator and said frame.

15. A printer according to claim 14 wherein said shear is pivotally carried by said carriage, and means connecting said actuator and said paper shear for pivoting said paper shear between said engaged position and said disengaged position in response to engagement of said actuator and said frame.

16. A printer according to claim 15 wherein said actuator is mounted for linear sliding movement relative to said carriage.

17. A printer according to claim 14 wherein said actuator has a pair of elements for engaging said frame respectively in response to traversing movement of said carriage in opposite directions, one element engaging said frame on one side of said carriage for moving said paper shear from said engaged position to said disengaged position and the other of said elements engaging said frame on the other side of said carriage for moving said paper shear from said disengaged position to said engaged position.

18. A printer according to claim 17 including a spring carried by said carriage for maintaining said paper shear in said engaged and disengaged positions.

19. In a paper printer carrying a paper shear and a shear platen, a method of shearing the printer paper comprising the steps of:

providing the paper shear with a substantially square cutting edge;

displacing said paper shear from a first position spaced from said shear platen into a second position adjacent an edge of said shear platen;

traversing the paper shear across the width of the paper in the printer when the paper shear lies in said second position;

when in said second position, engaging said paper shear with said platen such that said substantially square cutting edge of said paper shear engages the paper and said edge of said platen to shear the paper in response to traversing movement of said paper shear;

and providing cam means on said shear platen for selectively engaging said paper shear and said platen such that, when engaging said platen, said paper shear engages the paper to shear the paper in response to traversing movement of said paper shear.

20. A method according to claim 19 including the steps of biasing said paper shear against said edge and maintaining said edge in biased engagement with said edge during traversing movement of said paper shear.

21. A method according to claim 19 including the steps of establishing a clearance between said shear and said platen adjacent an end of the traversing movement of said shear and eliminating said clearance in response to traversing movement of said shear to engage said shear against said edge to shear the paper in response to further traversing movement.

* * * * *